United States Patent [19]

Gueldenzopf

[11] Patent Number: 4,532,063

[45] Date of Patent: Jul. 30, 1985

[54] DISSOLVABLE BLEACH SHEET

[75] Inventor: Thomas D. Gueldenzopf, Racine, Wis.

[73] Assignee: S. C. Johnson & Son, Inc., Racine, Wis.

[21] Appl. No.: 523,316

[22] Filed: Aug. 15, 1983

[51] Int. Cl.[3] ..... C11D 17/06

[52] U.S. Cl. ..... 252/90; 252/91; 252/134; 252/174; 252/174.17; 252/186.2; 252/186.25; 252/186.27; 252/186.34; 252/186.35; 252/DIG. 2; 252/DIG. 3; 252/DIG. 15; 252/DIG. 16

[58] Field of Search ..... 252/174.13, 174.17, 252/186.2, 186.25, 186.27, 186.34, 186.35, 90, 91, 92, 134, 174, DIG. 2, DIG. 3, DIG. 16, DIG. 15

[56] References Cited

U.S. PATENT DOCUMENTS 3,322,674 5/1967 Friedman ..... 252/90
3,904,543 9/1975 Knighten ..... 252/174
4,269,723 5/1981 Barford et al. ..... 252/174.17
4,279,764 7/1981 Brubaker ..... 252/186.34

FOREIGN PATENT DOCUMENTS 714111 7/1965 Canada .
165998 12/1980 Japan .

OTHER PUBLICATIONS

"Binding Activity of Hydroxypropyl Cellulose and its Effect on the Physical Characteristics of Granules and Tablets" Farmaco, Ed. Part. 1977, 32 (4), 157–171, CA 86: 195164n.

*Primary Examiner*—Paul Lieberman
*Assistant Examiner*—Hoa Van Le

[57] ABSTRACT

A dissolvable bleach sheet composition comprising a bleaching compound, a water-soluble film forming polymer, a solubilizer and a surfactant.

9 Claims, No Drawings

DISSOLVABLE BLEACH SHEET

BACKGROUND OF THE INVENTION

This invention relates to a laundry care product. More particularly, this invention relates to a laundry care bleach available in dry, pre-measured form.

It has long been considered desirable to add a bleaching agent to the wash water in a home or commercial laundry. By including a bleaching agent, stubborn or difficult stains can be removed from the clothes by the bleaching action of a bleaching agent.

At the present time, bleaches fall into two categories: liquid chlorine bleaches, which are aqueous solutions of sodium hypochlorite, and dry, oxygen bleaches based on various per-type compounds, such as peroxides, perborates, etc. Chlorine bleaches have the advantages of cost, they are relatively inexpensive, and have a high degree of bleaching activity. However, this latter advantage also is a disadvantage as a very active bleaching agent can damage some colors and fabrics and the bleach must be added to the wash water as a dilute solution.

In addition to the above two bleaching agents, there are a number of solid chlorine-type bleaching compositions available. These compositions dissolve in water to form an active bleaching species such as sodium hypochlorite which then functions as the bleach. These compositions have not been usable in a home laundry environment since concentrated areas of bleach may come in contact with garments to create pin hole bleaching, i.e., light over-bleached spots on the garment.

There have been attempts to utilize these dry chlorine bleaches in a home laundry environment by combining the same in dissolvable packets and the like. However, these packets have not been successful because the packets, while water soluble under most conditions, may became water-insoluble after prolonged contact with an oxidizing agent such as a dry bleach, and localize the bleach until the packet is dissolved.

BRIEF DESCRIPTION OF THE INVENTION

It has now been surprisingly found that a storage stable, dry bleaching composition can be prepared in sheet form. These bleach sheet compositions include a dry particulate bleaching compound; a bleach stable film-forming polymer which is soluble in water, a solubilizer and a bleach stable surfactant.

OBJECTS AND ADVANTAGES

It is the primary object of the present invention to provide a storage-stable bleach sheet.

It is a further object of the present invention to provide a bleach sheet suitable for use in laundry containing a premeasured amount of a particulate bleaching agent.

It is a still further object of the present invention to provide a bleach sheet which will substantially dissolve during a wash cycle and rinse.

It is a still further object of the present invention to provide a means for delivering particulate bleaching compounds to the wash medium without damaging fabrics.

it is a still further object of the present invention to provide a bleach sheet product containing a particulate bleach.

Still further objects and advantages of the composition of the present invention will become more apparent from the following more detailed description thereof.

DETAILED DESCRIPTION

The bleach sheets of the present invention comprise a dry particulate bleaching composition; a bleach stable, film-forming, water-soluble polymer, a solubilizer and a bleach stable surfactant wherein the weight ratio of bleaching compound to polymer is within the range of from 10:1 to 1:2, the weight ratio of solubilizer to polymer is within the range from 3:1 to 1:20 and the weight ratio of surfactant to polymer is from 1:1 to 1:20 and wherein content of the bleaching compound in the sheet is from 2 to 20 grams.

The active component in the compositions of the present invention include a dry particulate bleaching composition. The actual percentage of bleach in the sheet is not critical. It is important that sufficient bleach be available so that an effective level of bleaching species is released in the wash liquor. It has been found that it is necessary to deliver from about 2 to 20 grams of bleaching compound to a typical wash liquor depending on the amount of available bleaching species in the bleaching composition. The actual percentage of bleach in the final sheet will depend on a number of factors including the size of the sheet, the thickness of the sheet, and other additives. For this reason, it is convenient to discuss the amount of bleach in terms of a weight ratio of bleach to substrate-forming polymer. For typical sheets, the ratio of bleach to polymer should be from 10:1 to 1:2. At 10:1, the sheet is beginning to lose its integrity as a sheet and at 1:2 the sheet has to be so large that it is no longer economical to manufacture and is too large and bulky to use conveniently. It is preferred that the weight ratio be from about 5:1 to 1:1 and the optimum ratio is 3:1 to 2:1.

As noted above, the bleach sheets of the present invention must be capable of delivering from 2 to 20 grams and preferably 5 to 20 grams of active bleaching agent to the wash liquor.

Suitable chlorine-type bleaching agents include alkali metal and alkaline earth metal hypochlorites, hypochlorite addition products, chloramines, chlorimines, chloramides, and chlorimides. Specific examples of compounds of this type include potassium hypochlorite, lithium hypochlorite, calcium hypochlorite, calcium hypochlorite dihydrate, monobasic calcium hypochlorite, dibasic magnesium hypochlorite, chlorinated trisodium phosphate dodecahydrate, potassium dichloroisocyanurate, sodium dichloroisocyanurate, sodium dichloroisocyanurate dihydrate, 1,3-dichloro-5,5-dimethylhydantoin, N-chlorosulfamide, Chloramine T, Dichloramine T, Chloramine B, Dichloramine B, and Di-Halo (bromochlorodimethyl hydantoin), N-chlorosuccinimide, N-chloromalonimide, N-chlorophthalimide, and [mono-(trichloro)-tetra-(mono-potassium dichloro)]pentaisocyanurate. Other imides which are useful are hydantoins such as 1,3-dichloro-5,5-dimethylhydantoin, N-monochloro-5,5-dimethylhydantoin, methylene-bis(N-chloro-5,5-dimethylhydantoin), 1,3-dichloro-5-methyl-5-isobutylhydantoin, 1,3-dichloro-5-methyl 5-ethylhydantoin. 1,3-dichloro-5,5-diisobutylhydantoin, and 1,3-dichloro-5-methyl-5-n-amylhydantoin.

Additional useful organic compounds are trichloromelamine, N-chloromelamine, monochloramine, dichloramine, paratoluene sulfondichloroamide, N,N-dichloroazodicarbonamide, N-chloroacetyl urea, N,N-dichlorobiuret, chlorinated dicyandiamide, dichloroglycoluril, N,N-dichlorobenzoylene urea, and N,N-dichloro-p-toluenesulfonamide and mixtures, etc.

The preferred particulate bleaches are the chlorine donor bleaching compositions and particularly the chlorinated isocyanurates such as sodium dichloroisocyanurate, sodium dichloroisocyanurate dihydrate, potassium dichloroisocyanurate, potassium dichloroisocyanurate dihydrate and the like.

Suitable per-type bleaches include inorganic peroxy bleaches and organic peroxy bleaches.

By inorganic peroxy bleaches are meant inoraganic peroxyhydrates; examples are alkali metal salts of perborates, percarbonates, persulfates, persilicates, perphosphates, and perpolyphosphates.

By organic peroxy bleach is meant urea peroxide $CO(NH_2)_2H_2O_2$ or an organic peroxy acid or anhydride or salt thereof which has the general formula $$HO-O-\overset{\overset{\displaystyle O}{\|}}{C}-R-Y$$

wherein R is an alkylene group containing from 1 to about 20 carbon atoms, preferably 7 to 16 carbon atoms, or a phenylene group and Y is hydrogen, halogen, alkyl, aryl or any group which provides an anionic moiety in aqueous solution. Such Y groups can include, for example, $$-\overset{\overset{\displaystyle O}{\|}}{C}-OM,\ -\overset{\overset{\displaystyle O}{\|}}{C}-O-OM \text{ or } -\underset{\underset{\displaystyle O}{\|}}{\overset{\overset{\displaystyle O}{\|}}{S}}-OM$$

wherein M is H or a water-soluble, salt-forming cation.

The organic peroxyacids and salts thereof operable in the instant invention can contain either one or two peroxy groups and can be either aliphatic or aromatic. When the organic peroxyacid is aliphatic, the unsubstituted acid has the general formula $$HO-O-\overset{\overset{\displaystyle O}{\|}}{C}-(CH_2)_n-Y$$

where Y, for example, can be $CH_3$, $CH_2Cl$, $$-\overset{\overset{\displaystyle O}{\|}}{C}-OM,\ -\underset{\underset{\displaystyle O}{\|}}{\overset{\overset{\displaystyle O}{\|}}{S}}-OM \text{ or } -\overset{\overset{\displaystyle O}{\|}}{C}-O-OM$$

and n can be an integer from 1 to 20. Diperazelaic acid (n=7) and diperdodecanedioic acid (n=10) are the preferred compounds of this type. The alkylene linkage and/or Y (if alkyl) can contain halogen or other noninterfering substituents.

When the organic peroxyacid is aromatic, the unsubstituted acid has the general formula $$H-O-O-\overset{\overset{\displaystyle O}{\|}}{C}-C_6H_4-Y$$

wherein Y is hydrogen, halogen, alkyl, $$-\overset{\overset{\displaystyle O}{\|}}{C}-OM,\ -\underset{\underset{\displaystyle O}{\|}}{\overset{\overset{\displaystyle O}{\|}}{S}}-OM \text{ or } -\overset{\overset{\displaystyle O}{\|}}{C}-O-OM$$

for example. The percarboxy and Y groupings can be in any relative position around the aromatic ring. The ring and/or Y group (if alkyl) can contain any noninterfering substituents such as halogen groups. Examples of suitable aromatic peroxyacids and salts thereof include monoperoxyphthalic acid, diperoxyterephthalic acid, 4-chlorodiperoxyphthalic acid, the monosodium salt of diperoxyterephthalic acid, the monomagnesium salt of monoperoxyphthalic acid, m-chloroperoxybenzoic acid, p-nitroperoxybenzoic acid, and diperoxyisophthalic acid.

These bleaching agents should be in dry form in the composition of the present invention. However, they should be readily dissolvable in warm, hot or cold water to effectively provide bleaching action in the wash liquor. The preferred dry bleaching compositions are sodium dichloroisocyanurate dihydrate, sodium dichloroisocyanurate, potassium dichloroisocyanurate dihydrate, potassium dichloroisocyanurate, sodium perborate monohydrate, sodium perborate tetrahydrate, sodium percarbonate and mixtures thereof.

The second component of the present invention provides a film or medium which contains the bleaching component. These materials must be bleach stable, film-forming, water-soluble polymers. By the term "bleach stable" is meant that these materials must be sufficiently stable in the presence of chlorine and oxygen bleaches so that they retain their water solubility. Many water soluble sheet forming materials are not suitable for use in the present invention since it is known that these materials upon storage will cross-link in the presence of an oxidizing agent such as chlorine bleach to form a water insoluble film or sheet. Furthermore, since the particulate bleaching materials must be maintained in a substantially dry state, the film-forming materials must be capable of forming a film either from a non-aqueous solvent or be sufficiently thermoplastic so that they can be extruded.

A suitable bleach stable water-soluble film-forming polymer is hydroxypropyl cellulose. The preferred hydroxypropyl celluloses are those sold under the tradename Klucel from Hercules, Inc., Wilmington, Del. Preferably, the hydroxypropyl cellulose should have at least 2.5 moles of propylene oxide per anhydroglucose unit and should have a molecular weight of less than 1,000,000.

As noted above, the film-forming materials should be sufficiently soluble in a non-aqueous solvent so that they can be cast from this solvent medium or should be sufficiently thermoplastic so that they can be formed into sheet form using known sheet forming methods such as extrusion. The compositions of the present invention can be formed by dissolving the chlorine stable film-forming material in a suitable solvent such as methylene chloride, along with the bleaching agent. The bleaching agent need not be soluble in solvent but should be capable of being suspended along with the polymer. The other materials, such as alkalinity agents and surfactants, are also added at this time. The film is then cast into sheet form and later cut up into the desired shape and size.

If extrusion is to be utilized, it may not be possible to combine all the components of the present invention together at that time. In this method, the film-forming material may be extruded and the particulate bleaching composition, as well as other dry components may be dusted onto the hot surface of the film and adhere thereto. Alternatively, the above process can be utilized and active bleaching agents can be covered with a second sheet of the same film-forming, water-soluble polymer. The amount of water-soluble, film-forming polymer is not critical per se, but sufficient film former should be used to conveniently deliver the required amount of bleach to the wash liquor. As discussed above, the ratio of bleach to sheet should be within the range of 10:1 to 1:2. It is preferred that a ratio of 5:1 to 1:1 be used and optimally a ratio of 3:1 to 2:1 should be used.

It has also been found that the inclusion of a small amount of a solubilizer is very helpful in aiding dissolution of the sheet in the wash liquor. Suitable solubilizers include compounds such as sodium carbonate, sodium phosphate, sodium bicarbonate, sodium pyrophosphate, sodium tripolyphosphate, sodium borate, sodium citrate, sodium silicate, sodium hydroxide, sodium sulfate, the zeolites, etc. Mixtures of these materials can be used. Furthermore, these materials often are present in laundry care products as builders and also increase the detergency of the overall system. The preferred solubilizers are sodium carbonate, zeolites and mixtures. The ratio of solubilizer to polymer should be within the range of 1:20 to 3:1 and preferably within the range of 1:10 to 1:2 and optimally within the range of 1:4 to 1:2.

The compositions also may include a small amount of surfactant. It has been found that the inclusion of a small amount of surfactant into the composition aids in the dissolution of the sheet during the wash cycle. Suitable surfactants should be compatible with the other components of the composition of the present invention and should be stable in the presence of bleaching agents, especially chlorine bleaches. Suitable surfactants include anionic surfactants such as sodium lauryl sulfate, sodium dioctyl sulfosuccinate, linear alkyl benzene sulfonate, alpha-olefin sulfonate, xylene sulfonate, etc. Other anionic surfactants do not provide complete dissolution of the sheet but allow the bleach to be properly released. Most nonionic surfactants provide proper bleach release but do not impart proper dissolution characteristics to the sheet. It has been found that a ratio of surfactant to polymer of from 1:20 to 1:1 should be utilized. It is preferred that from 1:10 to 1:2 be utilized and optimally a ratio of 1:6 to 1:2 should be utilized.

The compositions of the present invention also may include small amounts of materials such as plasticizers, chlorine stable perfumes and the like. These materials can be present in the compositions of the present invention in an amount not exceeding 5% by weight of each additive.

As noted above, the bleach sheet compositions of the present invention can be prepared by a number of conventional sheet-forming methods. One method comprises dissolving the film-forming polymer in a non-aqueous solvent such as methylene chloride. To this film-forming liquid is added the dry particulate bleaching agent, alkaline material and detergent. This is then cast into a film by placing the composition in a pan and allowing the solvent to evaporate.

An alternative method for preparing the sheets of the present invention comprises extruding the film-forming composition into a sheet. This extruded sheet can be the film-forming polymer itself or it could be the film-forming polymer mixed with a small percentage of the alkaline materials, surfactant or plasticizer, if necessary. This extruded film is then contacted with the dry bleaching agent. Although it is not necessary, it may be considered desirable to place a second sheet of film-forming material on top of the dry bleaching agent to firmly lock the same in place between two sheets of thermoplastic film-forming material.

The compositions of the present invention will now be illustrated by way of the following examples which are for the purposes of illustration only and are in no way to be considered as limiting. In the following examples, all parts and percentages are by weight and all temperatures are in degrees Fahrenheit.

EXAMPLE 1

A substantially water soluble bleach sheet is prepared having the following formulation:

| | |
|---|---|
| Hydroxypropylcellulose (Klucel E-Hercules Chemical Co.) | 4.00 grams |
| Dimethylpolysiloxane, 100 cstks (DC-200 Dow Corning) | 0.40 grams |
| Sodium linear alkylbenzene sulfonate (Sulframin 90 Witco Chemical) | 1.08 grams |
| Type 4A Zeolite (ZB-100 Union Carbide) | 1.23 grams |
| Sodium dichloroisocyanurate dihydrate (ACL 56 Monsanto) | 10.00 grams |

The bleach sheet is prepared by dissolving the Klucel E, DC-200 and Sulframin 90 in 150 ml of methylene chloride. The zeolite is then dispersed in the above solution and one half of the zeolite containing dispersion is poured into a 6"×8" baking dish having a silicone-based, non-stick coating. The dispersion is allowed to air dry until the methylene chloride has evaporated. The ACL 56 is then uniformly sprinkled over the dried film and then sprayed with a small amount of methylene chloride to soften the film and temporarily bind the ACL 56 particles. The film is allowed to air dry. The remaining zeolite containing dispersion is then poured over the ACL 56 containing film and is air dried thoroughly to remove the solvent.

The above sheets are placed in a standard top loading automatic washing machine using 110° F. water along with one cup of detergent (Tide detergent, Procter and Gamble) and used to launder four stain swatches containing tea, cherry, grass and grape stains plus six towels for ballast and agitated for ten minutes. After the wash cycle is completed, the stain swatches are removed and observed for Klucel particles, substantially none were found and those observed were very small. The towels were removed and shook over a dark surface to see if there were any Klucel particles. Again, there were only very few small particles observed.

The stain swatches were evaluated and about 90% of the stains were removed based on color difference readings.

EXAMPLE 2

Using the same procedure as Example 1, except that a 10"×15" pan was used, and that sodium carbonate is used in place of zeolite, bleach sheets having the formulations as shown in Table 1 were found. Sheets are cut to size such that each contains 10.0 g ACL 56.

TABLE 1

| | Run | | | | |
|---|---|---|---|---|---|
| | A[1] | B[1] | C[2] | D[3] | E[4] |
| Klucel E | 3.25 g | 6.50 g | 32.50 g | 65.00 g | 32.50 g |
| DC-200 | 0.32 g | 0.65 g | 3.25 g | 6.50 g | 3.25 g |
| Soda Ash | 0.65 g | 1.30 g | 6.50 g | 13.00 g | 6.50 g |
| Sulframin 90 | 0.40 g | 0.80 g | 4.00 g | 8.00 g | 4.00 g |
| ACL 56 | 32.50 g | 32.50 g | 32.50 g | 32.50 g | 16.25 g |
| Ratio of ACL: Klucel | 10:1 | 5:1 | 1:1 | 1:2 | 1:2 |
| Solubility | good | good | moderate | moderate | moderate |
| Bleaching | good | good | good | good | good |

[1]Runs A–B used about 225 ml of methylene chloride.
[2]Run C used about 525 ml of methylene chloride.
[3]Run D used about 525 ml of methylene chloride, poured as 8 layers.
[4]Run E used about 525 ml of methylene chloride, poured as 4 layers.

The bleaching and solubility tests were run as in Example 1 and the results are shown in Table 1 above.

EXAMPLE 3

The procedure of Example 1 was repeated, except that 225 ml of methylene chloride was used and the zeolite was replaced with the sodium carbonate, to make the formulations as shown in Table 2. The resulting sheets were cut such that each sheet contains 10.0 g ACL 56 and evaluated for solubility and bleaching as in Example 1.

TABLE 2

| | Run | | | | | | | | | | | |
|---|---|---|---|---|---|---|---|---|---|---|---|---|
| | A | B | C | D | E | F | G | H | I | J | K | L |
| Components | | | | | | | | | | | | |
| Klucel E | 13.0 | 13.0 | 13.0 | 13.0 | 13.0 | 13.0 | 13.0 | 13.0 | 13.0 | 13.0 | 13.0 | 13.0 |
| DC-200 | 1.3 | 1.3 | 1.3 | 1.3 | 1.3 | 1.3 | 1.3 | 1.3 | 1.3 | 1.3 | 1.3 | 1.3 |
| $Na_2CO_3$ | 2.6 | 2.6 | 1.3 | 1.3 | 6.5 | 0.65 | 6.5 | 0.65 | 0.65 | 6.5 | 6.5 | 0.65 |
| Sulframin 90 | 6.5 | 0.65 | 6.5 | 0.65 | 2.6 | 2.6 | 1.3 | 1.3 | 6.5 | 6.5 | 0.65 | 0.65 |
| ACL 56 | 32.5 | 32.5 | 32.5 | 32.5 | 32.5 | 32.5 | 32.5 | 32.5 | 32.5 | 32.5 | 32.5 | 32.5 |
| Ratios | | | | | | | | | | | | |
| Klucel: $Na_2CO_3$ | 5:1 | 5:1 | 10:1 | 10:1 | 2:1 | 20:1 | 2:1 | 20:1 | 20:1 | 2:1 | 2:1 | 20:1 |
| Klucel: Sulframin | 2:1 | 20.1 | 2:1 | 20:1 | 5:1 | 5:1 | 10.1 | 10:1 | 2:1 | 2:1 | 20:1 | 20:1 |
| Performance | | | | | | | | | | | | |
| Bleaching | good | good | good | good | good | good | good | good | good | good | good | good |
| Solubility | good | moderate | moderate | poor | moderate | moderate | good | moderate | poor | very good | very good | very poor |

COMPARATIVE EXAMPLE 1

Using the procedure of Example 3, these bleach containing sheets were prepared having the formulation as set forth in Table 3. These sheets were tested using the procedure of Example 1. Each of these runs shows the importance of having both a solubilizer ($Na_2CO_3$) and surfactant present in order to obtain proper sheet solubility and/or dispersibility.

TABLE 3

| | A | B | C |
|---|---|---|---|
| Klucel E | 13.0 g | 13.0 g | 13.0 g |
| DC-200 | 1.3 | 1.3 | 1.3 |
| $Na_2CO_3$ | — | 2.6 | — |
| Sulframin 90 | 2.6 | — | — |
| ACL 56 | 32.5 | 32.5 | 32.5 |
| Solubility | Moderate | Very Poor | Very Poor |
| Bleaching | Good | Good | Good |

EXAMPLE 4

The procedure of Example 2 is repeated except that the sodium carbonate is replaced with the materials as shown in Table 4. The bleaching and solubility performance were tested as in Example 1.

| | |
|---|---|
| Klucel E | 13.0 g. |
| DC-200 | 1.3 |
| Solubilizer See Table 4 | 6.5 |
| Sulphramin 90 | 2.6 |
| ACL 56 | 32.5 |

TABLE 4

| Run | Solubilizer | Solubility | Bleaching |
|---|---|---|---|
| A | Sodium tripolyphosphate | Moderate | Good |
| B | Sodium Citrate | Poor | Good |
| C | Borax (5 mole hydrate) | Poor | Good |
| D | Sodium metasilicate | Moderate | Good |
| E | Sodium sulfate | Poor | Good |
| F | Sodium phosphate (tribasic) | Good | Good |
| G | Sodium Bicarbonate | Poor | Good |
| H | Sodium hydroxide | Poor | Good |
| I | Sodium sesquicarbonate | Good | Good |

EXAMPLE 5

Using the procedure of Example 1, the following formulation was prepared:

| | |
|---|---|
| Klucel E | 13.0 g. |
| DC-200 | 1.3 |
| ZB-100 | 4.0 |
| Surfactant (See Table 5) | 3.5 |
| ACL 56 | 32.5 |

The formulas were tested for solubility by placing a 0.26 g. sample of the sheet into a beaker of tap water having the temperature indicated. The time to disolution of the sheet was noted.

TABLE 5

| Run | Surfactant | 110° F. Min. | 60° F. Min. | 130° F. Min. |
|---|---|---|---|---|
| A | Sulframin 90 | 3'59" | 9'46" | 3'17" |
| B | Stepanol ME 1 | 10'42" | >30' | 30' |
| C | Aerosol OT-100[2] | 8'56" | 20' | >30' |
| D | Siponate 301-10F[3] | 7'30" | >30' | >30' |
| E | Hostapur SAS-93[4] | 3'53" | 13'28" | >30' |

TABLE 5-continued

| Run | Surfactant | 110° F. Min. | 60° F. Min. | 130° F. Min. |
|---|---|---|---|---|
| The above sheets all released bleach properly. | | | | |

[1]Sodium Lauryl Sulfate
[2]Sodium dioctyl sulfosuccinate
[3]Sodium alpha olefin sulfonate
[4]Sodium secondary alkane sulfonate

EXAMPLE 6

Example 5 was repeated except that the surfactants used are those as shown in Table 6.

| Run | Surfactant | 60° F. | 110° F. | 140° F. |
|---|---|---|---|---|
| A | Plurafac A39[1] | Sol[2] | Sol | Not sol[3] |
| B | Witconate SXS[4] | Sol | Sol | Not sol |
| C | Neodol 25-12[5] | — | Not Sol | — |
| D | Tergitol 15-S-15[6] | — | Not Sol | — |
| E | Pluronic F-38[7] | — | Not Sol | — |
| F | Pluronic L-35[7] | — | Not Sol | — |
| G | Pluronic 10R5[8] | — | Not Sol | — |

[1]Ethoxylated/propoxylated fatty alcohol
[2]Completely soluble
[3]Not completely soluble
[4]Sodium xylene sulfonate
[5]$C_{12-15}$ fatty alcohol ethoxylate with 12 moles ethylene oxide
[6]Ethoxylated secondary alcohol
[7]Ethoxylate/propoxylate block copolymer - propylene oxide backbone
[8]Ethoxylate/propoxylate block copolymer - ethylene oxide backbone

What I claim is:

1. A storage stable laundry bleach sheet soluble in water and containing a composition comprising a dry particulate bleaching compound selected from the group consisting of sodium dichloroisocyanurate dihydrate, sodium dichloroisocyanurate, potassium dichloroisocyanurate dihydrate, potassium dichloroisocyanurate, sodium perborate monohydrate, sodium perborate tetrahydrate and sodium percarbonate and mixtures thereof; a bleach stable film-forming water-soluble hydroxypropyl cellulose polymer having at least 2.5 moles of propylene oxide per anhydroglucose unit and having a molecular weight of less than 1,000,000; a solubilizer selected from the group consisting of sodium carbonate, sodium phosphate, sodium bicarbonate, sodium pyrophosphate, sodium tripolyphosphate, sodium borate, sodium citrate, sodium silicate, sodium hydroxide, sodium sulfate, zeolite and mixtures thereof and a bleach-stable surfactant wherein the weight ratio of bleaching compound to polymer is within the range from 10:1 to 1:2; the weight ratio of solubilizer to polymer is within the range from 3:1 to 1:20 and the weight ratio of surfactant to polymer is within the range of from 1:1 to 1:20 and wherein the bleach sheet contains from 2 to 20 grams of bleaching compound.

2. The bleach sheet of claim 1 wherein the bleaching composition is sodium dichloroisocyanurate dihydrate.

3. The bleach sheet of claim 1 wherein the the ratio of bleaching composition to polymer is within the range of from about 5:1 to 1:1.

4. The bleach sheet of claim 1 wherein the ratio of bleaching composition to polymer is within the range of from about 3:1 to 2:1.

5. The bleach sheet of claim 1 wherein the ratio of solubilizer to polymer is within the range of 1:10 to 1:2.

6. The bleach sheet of claim 1 wherein the ratio of solubilizer to polymer is within the range of from 1:4 to 1:2.

7. The bleach sheet of claim 1 wherein the ratio of surfactant to polymer is within the range of from 1:10 to 1:2.

8. The bleach sheet of claim 1 wherein the ratio of surfactant to polymer is within the range of from 1:6 to 1:2.

9. The bleach sheet of claim 1 wherein the surfactant is selected from the group consisting of sodium laurylsulfate, sodium dioctylsulfosuccinate, linear alkyl benzene sulfonate, alpha olefin sulfonate, xylene sulfonate and mixtures thereof.

* * * * *